US006684870B1

(12) United States Patent
Land

(10) Patent No.: US 6,684,870 B1
(45) Date of Patent: Feb. 3, 2004

(54) SPLIT LIMB ARCHERY BOW APPARATUS

(75) Inventor: Spencer D. Land, Henderson, NV (US)

(73) Assignee: Spenco, Dunlap, TN (US)

( * ) Notice: Subject to any disclaimer, the term of this patent is extended or adjusted under 35 U.S.C. 154(b) by 0 days.

(21) Appl. No.: 10/115,642

(22) Filed: Apr. 3, 2002

(51) Int. Cl.[7] ..... F41B 5/00; F41B 5/10; F41B 5/20

(52) U.S. Cl. ..... 124/23.1; 124/25.6; 124/89

(58) Field of Search ..... 124/23.1, 25.6, 124/86, 89

(56) References Cited

U.S. PATENT DOCUMENTS 4,644,929 A * 2/1987 Peck
5,377,658 A * 1/1995 Shepley ..... 124/23.1 X
5,720,267 A * 2/1998 Walk ..... 124/23.1
5,722,380 A * 3/1998 Land et al. ..... 124/25.6
5,947,099 A * 9/1999 Derus ..... 124/25.6
6,253,752 B1 * 7/2001 Cox et al. ..... 124/23.1
6,298,842 B1 * 10/2001 Sims ..... 124/89

* cited by examiner

*Primary Examiner*—John A. Ricci
(74) *Attorney, Agent, or Firm*—Reising, Ethington, Barnes, Kisselle, P.C.

(57) ABSTRACT

An archery bow has a pair of limbs with at least one of the limbs having a split section defining a pair of limb sections generally separate from each other. A connecting member is received within the split section to connect the limb sections to each other between a point of string attachment and a handle portion of the bow. The connecting member limits relative movement between the limb sections.

24 Claims, 3 Drawing Sheets

SPLIT LIMB ARCHERY BOW APPARATUS

BACKGROUND OF THE INVENTION

1. Field of the Invention

This invention relates generally to archery bows and more specifically to an archery bow having split limb portions.

2. Related Art

Archery bows may include two limbs interconnected by a handle or riser with a string trained between the limbs so that drawing the string stores energy in the limbs to propel an arrow upon release of the string. The limbs have been made from a solid, uninterrupted piece of material. The string is attached directly to the ends of the limbs, or to pulleys or cams attached to the ends of the limbs with the string trained around the pulleys or cams.

To accommodate the pulleys or cams of compound bows, the limbs have a split portion creating separate limb sections between the handle portion and the point of string attachment to the bow limbs. The limb sections are either formed from a partial split in the limbs, or from a complete split spanning the length of the limbs. Split limbs can reduce the weight of the bow, but more importantly to the bow enthusiast, it can increase the speed of an arrow shot from the bow. The limb sections may flex unequally creating imbalances or twisting of the limbs that can reduce the efficiency of the bow, and increase noise and vibration produced by the bow in use.

SUMMARY OF THE INVENTION

An archery bow has a handle portion having spaced apart ends with a pair of limbs attached to each end. The limbs each have a free end spaced from the handle portion providing for a point of string attachment adjacent the free ends. At least one of the limbs, and preferably both limbs have a split section defining a pair of limb sections spaced from one another between the handle portion and the point of string attachment. A connecting member connecting the limb sections to each other is received between the handle portion and at least one of the points of string attachment. With the connecting member in place, the spaced apart limb sections flex and return more uniformly relative to one another to provide more uniform flexing of the limb, increase efficiency of the bow, and reduce noise and vibration in the bow.

In a preferred embodiment, a bow has a riser to which a pair of bow limbs are attached. The bow limbs have free ends with a pulley rotatably mounted on the limb adjacent each free end. At least one of the limbs has a split section defining a pair of separate limb sections between the riser and the pulley. A connecting member connecting the pair of limb sections to each other is received between the riser and at least one pulley. Desirably, this may provide more uniform flexing of the limb, increase the efficiency of the bow, and reduce noise and vibration in the bow, among other benefits or advantages.

Some objects, features and advantages of a preferred embodiment of this invention include, but are not limited to, limiting relative movement between the limb sections of a bow limb having a split section to ensure uniform flexing of the limb sections, maximizing the energy potential of the limbs, increasing arrow speed, reducing noise and vibration of the bow, permitting a user to shoot the bow for an extended period of time with less fatigue, and prolonging the useful life of limbs, bolts, strings, cam and idler pulley bearings, axles and that of the bow in general. Other objects, features and advantages will be apparent to those skilled in the art.

BRIEF DESCRIPTION OF THE DRAWINGS

These and other objects, features and advantages of this invention will be apparent from the following detailed description of the preferred embodiments and best mode, appended claims, and accompanying drawings in which:

DETAILED DESCRIPTION OF THE PREFERRED EMBODIMENTS

Figure 1:
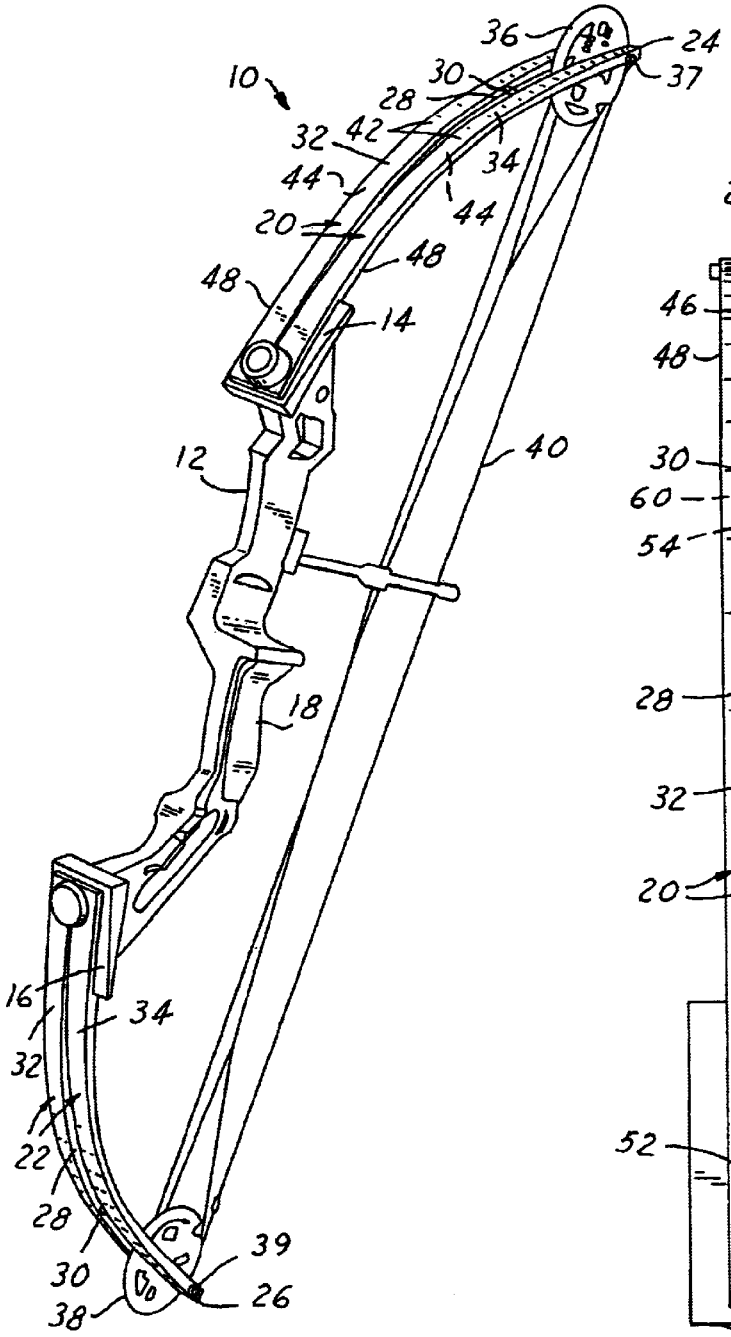
FIG. 1 is a perspective view of an archery bow showing connecting members joining limb sections to one another.

Referring in more detail to the drawings, FIG. 1 illustrates an archery bow 10 having a riser 12 with opposed ends 14, 16, a handle portion 18 between the ends 14, 16, and a pair of limbs 20, 22. Each limb 20, 22 is connected to a separate one of the ends 14, 16 of the riser 12, respectively, and has opposed free ends 24, 26 spaced from the riser 12. At least one of the limbs 20, 22, and preferably both limbs 20, 22 has a split section 28 spanning at least a portion of its length and defining a pair of limb sections 32, 34. A connecting member or dowel 30 interconnects the limb sections 32, 34 to restrain their relative movement during flexing of the limbs 20, 22. A pulley or cam 36 is rotatably carried by an axle 37 mounted to one limb 20 adjacent its free end 24 and a pulley or idler wheel 38 is rotatably carried by another axle 39 mounted on the other limb 22 adjacent its free end 26. A bowstring 40 is trained around both the cam 36 and the idler wheel 38. The bow string 40, with an arrow disposed thereon, is drawn away from the riser 12 to store energy in the limbs 20, 22 and then released to propel the arrow towards a target. While the bow string 40 is drawn away from the riser 12, the dowel 30 connecting the limb sections 32, 34 of the bow limbs 20, 22 helps to ensure that the limb sections 32, 34 flex uniformly relative to each other so that any relative movement between the limb sections 32, 34 is limited. The substantially uniform flexing of the bow limbs 20, 22 provide the user with many benefits. Just a couple of the benefits include, but are not limited to, improving the efficiency of the bow 10, increasing the speed of an arrow propelled from the bow, and minimizing vibration and noise of the bow.

Figure 2:
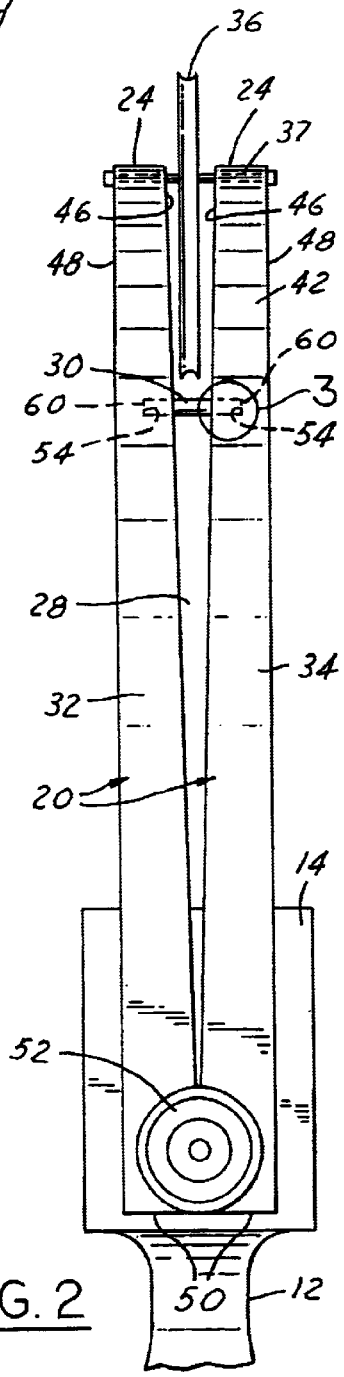
FIG. 2 is a fragmentary front view showing the upper half of the bow of FIG. 1.

The bow has two limbs 20, 22, but only one limb 20 is discussed here due to similarities between the two limbs 20, 22, unless specifically stated otherwise. As best shown in FIG. 2, in a first embodiment the limb 20 is split along its entire length defining the split section 28 and the pair of limb sections 32, 34 spaced from, or at least substantially separate from one another. The pair of limb sections 32, 34 extend between the handle portion 18 and a point of attachment of the bow string 40 to the limb 20. The string 40 is either directly attached to the limb 20 adjacent the free end 24 of the limb 20, thereby defining the point of attachment of the string 40 to the limb 20, or by way of the cam 36, which in turn is carried by the axle 37 mounting the cam 36 on the limb 20. In the latter case, the point of attachment of the axle 37 to the limb 20 defines the effective point of attachment of the string 40 to the limb 20. The limb 20 has an upper surface 42, a lower surface 44, inner and outer sides 46, 48, and a first end 50 for attachment to the riser 12 using a limb bolt 52, as known in the industry.

Figure 3:
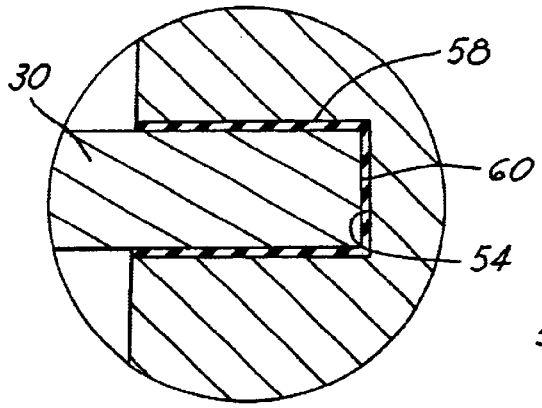
FIG. 3 is an enlarged fragmentary cross-sectional view of the encircled portion 3 in FIG. 2.
Figure 4:
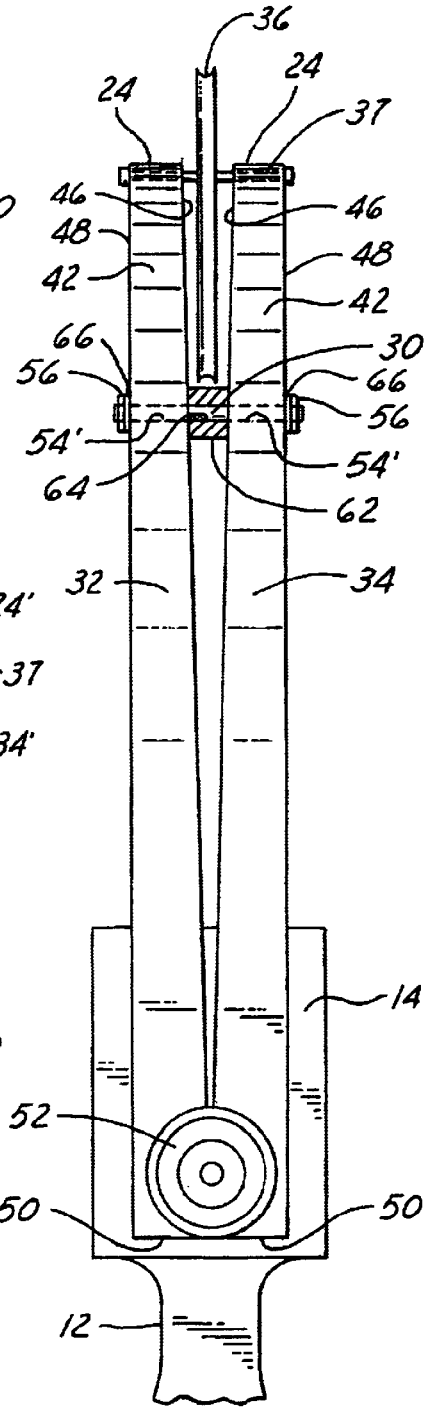
FIG. 4 is a fragmentary front view of a bow similar to FIG. 2 showing an alternative embodiment of a connecting member.

Prior to assembly, the limb sections 32, 34 are separate from one another and have blind holes 54 in their inner sides 46. As best shown in FIGS. 2 and 3, the holes 54 are generally perpendicular to a longitudinal axis of the limb sections 32, 34 such that after assembly of the limb sections 32, 34 to the riser 12, the blind holes 54 are in a mirrored, generally opposed and axially aligned relation to one another. It should be recognized that the holes 54 may be formed in substantially any shape to accommodate the shape of the connecting member 30 being used to join the limb sections 32, 34 to one another. For example, if the connecting member 30 were to be generally flat in shape, then instead of a hole, a slot (not shown) could be molded or machined into the separate limb sections 32, 34. Alternatively, as shown in FIG. 4, holes in the limb sections 32, 34 can be made as through holes 54' passing through the width of the limb sections 32, 34. The dowel 30, upon assembly of the limb sections 32, 34 to the riser 12 of the bow 10 passes from an external side 48 of one limb section 32 to the external side 48 of the other limb section 34. The dowel 30 can be inserted in the through holes 54' and permanently or releasably fixed in place by fasteners 56, shown here as C-clips, and nuts, cotter pins, or the like could be used, as well as a friction fit, adhesive, or the like. Also, a combination of the two may be used with one limb having a blind hole and the other a through hole.

Figure 5:
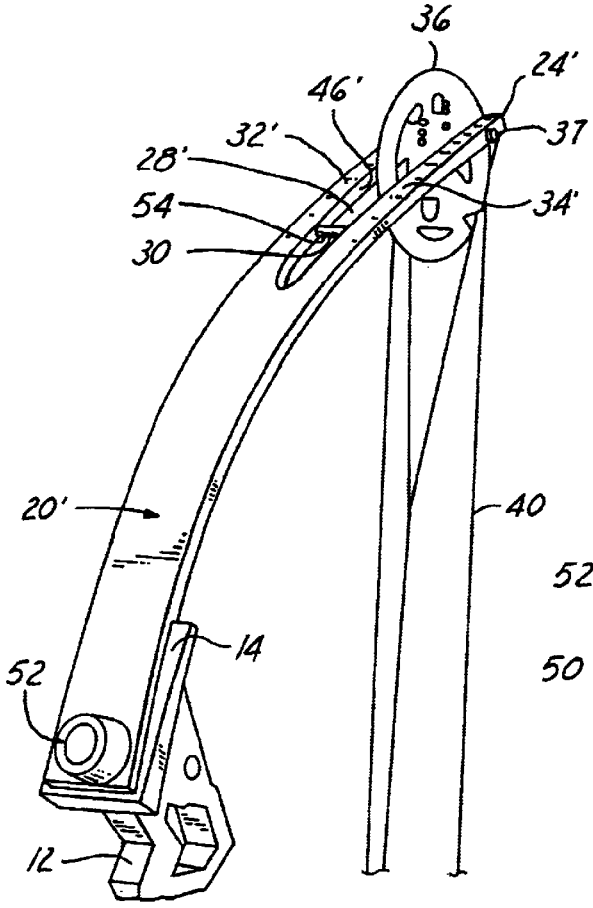
FIG. 5 is a fragmentary perspective view showing an alternate embodiment of a bow limb having a split section spanning a portion of the length of the bow limb.

As shown in FIG. 5, a second embodiment has a bow limb 20' with a split section 28' in the bow limb 20' that spans a portion of the length of the bow limb 20' such that the bow limb 20' is a single, unitary piece of material. Limb sections 32', 34' are generally defined by the split section 28'. Preferably, blind holes 54 are formed in the inner sides 46' of the limb sections 32', 34'. As discussed in the first embodiment, the holes 54' may be formed as through holes passing through the limb sections 32', 34'. It should be recognized that the length of the split section 28' in the bow limbs 20', 22' may range from anywhere between a full split section 28 as in the first embodiment, to a partial split section that may vary in length from one bow to the next.

As viewed in FIG. 3, each dowel 30 can have a coating 58 on and adjacent to at least its ends 60 with the coating 58 preferably being an elastomer or soft rubber to act as a vibration dampener between the dowel 30 and the limb sections 32, 34. The ends 60 of the -dowels 30, either with or without a coating, preferably maintain a snug fit within the holes of the limb sections 32, 34 by having a line-to-line or friction fit. Additionally, it should be recognized that though a single dowel 30 is shown here in each limb 20, 22, a plurality of connecting members 30 could be used in each limb 20, 22 to further limit relative movement between the limb sections 32, 34.

As shown in FIG. 4, in lieu of or in addition to the coating on the ends of the dowels 30, a dampener 62 having a through hole 64 can be received on each dowel 30 and between the limb sections 32, 34 to reduce noise and vibration that may otherwise be generated by the bow 10 while in use. The dampener 62 is preferably compressed somewhat between the limb sections 32, 34 to ensure it firmly engages the limb sections 32, 34 and may be formed from any suitable material, including but not limited to, elastomers or soft rubbers such as, but not limited to, Sorbothane, Neoprene, Nitril, or the like.

Figure 6:
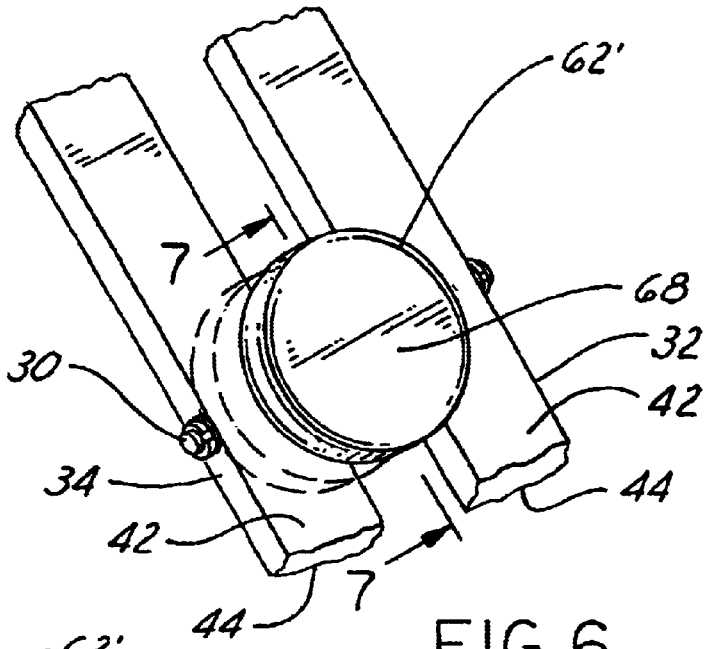
FIG. 6 shows a partial perspective view showing an alternate embodiment of a bow limb having a dampener disposed on a connecting member.
Figure 7:
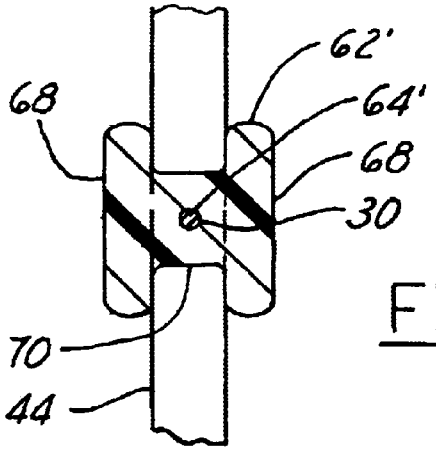
FIG. 7 shows a side view of the dampener from FIG. 6.

As shown in FIGS. 6 and 7, an alternate dampener 62' can be incorporated to reduce noise and vibration that may otherwise be generated by the bow 10 while in use. The dampener 62' is generally dumb bell shaped having enlarged ends 68 joined by a generally necked down portion 70. A through hole 64' passes through the necked down portion 70 so that the dampener 62' can be received preferably on each dowel 30 and between the limb sections 32, 34. The enlarged ends 68 overly and preferably abut the upper and lower surfaces 42, 44 of the limb sections 32, 34 to facilitate dampening of noise and vibration. The necked down portion 70 may be compressed somewhat between the limb sections 32, 34 to further reduce noise and vibration within the bow 10, though this is not necessary. The dampener 62' may be formed from any suitable material, including but not limited to, elastomers or soft rubbers such as, but not limited to, Sorbothane, Neoprene, Nitril, or the like.

Where the limb sections 32, 34 have through holes 54' therein for receiving the connecting member 30, and wherein fasteners 56 are used for securing the connecting member 30 to the bow limb 20, an additional dampener 66 may be employed between each fastener 56 and the outer sides 48 of the limb sections 32, 34 to further reduce noise and vibration generated by the bow 10 while in use. The dampener 66 may be formed from any suitable material, including but not limited to, a polymer, an elastomer, soft rubber, felt, plastic or the like and may be generally annular or any other suitable shape. It should be recognized that this dampener arrangement can also be employed with the second embodiment having a partially split limb 20'.

In assembly, where the limb sections 32, 34 are separate from one another as in the first embodiment, the dowel 30 may be inserted into the blind holes 54 of opposing limb sections 32, 34 prior to attaching the limb sections 32, 34 to the riser 12. With the dowel 30 inserted between the separate and opposing limb sections 32, 34, the limb sections 32, 34 can then be attached to the riser 12 wherein the dowel 30 is held in place by the limb sections 32, 34. The line-to-line fit of the dowel 30 within the blind holes 54, and the length of the dowel 30 extending into the blind holes 54 maintains the dowel 30 between the limb sections 32, 34 after assembly of the limb sections 32, 34 to the riser 12. Additionally, after assembly of the cam 36 and idler wheel 38 to the free ends 24, 26 of the limb sections 32, 34 via the axles 37, 39, the dowel 30 is securely maintained between the limb sections 32, 34.

As shown in FIG. 5, where the split section 28' extends through only a portion of the bow limb 20', and where blind holes 54 are used, the dowel 30 may be snapped into place. By slightly spreading the limb sections 32', 34', the dowel 30 can be pressed or snapped into the blind holes 54. Then, by releasing the limb sections 32', 34' and allowing them to flex back to their original, non-flexed position, the dowel 30 is securely maintained between the opposing limb sections 32', 34'. Also, lead in ramps or a chamfer (not shown) at an entrance to the blind holes 54 could be incorporated to facilitate insertion of the dowel 30.

Wherein the holes 54' in the limb sections 32, 34 are through holes, the dowel 30 can be easily inserted into the through holes 54' and secured by the fasteners 56 either before or after assembly of the split limb sections 32, 34 to the riser 12. It should be recognized that when a dampener 62 is used between the limb sections 32, 34, and wherein blind holes 54 are employed in the limb sections 32, 34, prior to installing the dowel 30, the dowel 30 is inserted through the hole 64 in the dampener 62 to dispose the dampener 62 on the dowel 30. Alternatively, where the limb sections 32, 34 have through holes 54', the hole 64 in the dampener 62 can be aligned with the through holes 54' in the limb sections 32, 34 so that when the dowel 30 is inserted, the dowel 30 passes through the hole 64 in the dampener 62 to dispose the dampener 62 on the dowel 30 and between the limb sections 32, 34.

In use, the dowel 30 enables the limb sections 32, 34, 32', 34' to flex more uniformly relative to one another and limits relative movement between the limb sections 32, 34, 32', 34'. By limiting the relative movement between the limb sections 32, 34, 32', 34', energy losses that otherwise result if the limb sections 32, 34, 32', 34' flex relative to one another can be reduced or eliminated. Therefore, the bow is able to operate at improved efficiencies to provide for an increase in propelled arrow speed. In prototype testing, increases in arrow speed of up to 6 feet/second were realized. Additionally, vibrations and noise otherwise generated from relative flexing between limb segments can be eliminated, thus improving the user's ability to accurately shoot the bow, to avoid frightening away hunted prey, to practice shooting for extended periods of time, and to improve the useful life of the archery bow components. This is only intended to be a partial list of benefits to be recognized from the present invention, and in no way should be viewed as comprehensive.

It will be appreciated by those skilled in the art that modifications and variations of this invention may be made without departing from the spirit and scope of the invention. For example, the connecting members are generally shown as generally cylindrical dowels 30 that are generally circular in cross-section. However, as mentioned above with respect to holes 54, 54', the connecting members can take on any suitable shape and could be generally flat, or plate shaped to fit within slots in the limb sections (not shown). Still other modifications within the spirit and scope of this invention will be apparent to persons of ordinary skill in the art. It should also be appreciated that the embodiments discussed above are only representative of preferred embodiments, and are not the only embodiments.

What is claimed is:

1. An archery bow, comprising:

a handle portion having spaced apart ends;

a pair of limbs each having one end attached to a separate one of the ends of the handle portion and a free end spaced from the handle portion and having a point of string attachment adjacent the free ends with at least one of the limbs having a split section defining a pair of limb sections at least substantially separate from one another between the handle portion and said point of string attachment with each limb section having an upper surface and a lower surface; and a connecting member connecting the limb sections to each other and mounted to the pair of limb sections between the upper and lower surfaces of the limb sections limiting relative movement between the pair of limb sections.

2. The archery bow of claim further comprising a dampener disposed on said connecting member.

3. The archery bow of claim 2 wherein said dampener is comprised of an elastomer and is compressed between said pair of limb sections.

4. The archery bow of claim 2 wherein said limb sections each have an inner side with the inner sides of the limb sections facing each other, and said dampener is carried by the connecting member between the inner sides the limb sections.

5. The archery bow of claim 2 wherein said limb sections each have an outer side and said dampener is carried by the connecting member adjacent to at least one of the outer sides of said limb sections.

6. The archery bow of claim 1 further comprising a hole through at least one of said limb sections for receiving said connecting member, and at least one fastener retaining said connecting member to said at least one of said limb sections.

7. The archery bow of claim 1 wherein at least one of said limb sections has a blind hole for receiving an end of said connecting member retaining said connecting member relative to said at least one of said limb sections.

8. The archery bow of claim 1 further comprising a coating on at least a portion of said connecting member acting as a dampener between said connecting member and a limb section.

9. The archery bow of claim 1 wherein each limb section has an inner side with the inner sides of the limb sections facing each other, said connecting member extending between the inner sides of the limb sections.

10. An archery bow, comprising:

a riser having spaced apart ends;

a pair of limbs each having one end attached to a separate one of the ends of the riser and a free end having a pulley attached adjacent each free end, with at least one of the limbs having a split section defining a pair of limb sections at least substantially separate from one another and defined between the riser and the pulley on said at least one of the limbs, each of said limb sections having an upper surface and a lower surface; and a connecting member carried by said at least one of the limbs in its split section between the upper surfaces and lower surfaces of the limb sections interconnecting the limb sections to each other limiting relative movement between the limb sections.

11. The archery bow of claim 10 further comprising a pair of axles each rotatably carrying a separate one of the pulleys and wherein the connecting member is received between the riser and at least one of said axles.

12. The archery bow of claim 10 further comprising a dampener disposed on said connecting member.

13. The archery bow of claim 12 wherein said dampener is compressed between said pair of limb sections.

14. The archery bow of claim 10 wherein said split section spans the entire length of said at least one of the limbs.

15. The archery bow of claim 10 wherein said split section spans a portion of the length of said at least one of the limbs.

16. A limb for an archery bow, comprising:

a body with one end attached to a handle portion of an archery bow and a free end having a point of string attachment generally adjacent to the free end and having a split section defining a pair of limb sections at least substantially separate from one another between said one end and said point of string attachment with each limb section having an upper surface and a lower surface; and a connecting member connecting the limb sections to each other and mounted to the pair of limb sections between the upper surfaces and lower surfaces limiting relative movement between the pair of limb sections.

17. The limb of claim 16 further comprising a dampener disposed on said connecting member.

18. The limb of claim 17 wherein said dampener is comprised of an elastomer.

19. The limb of claim 16 wherein said split section spans the entire length of said limb.

20. The limb of claim 16 wherein said split section spans a portion of the length of said limb.

21. A limb for an archery bow, comprising:

a body with one end attached to a handle portion of an archery bow and a free end having a point of string attachment generally adjacent to the free end and having a split section defining a pair of limb sections at least substantially separate from one another between said one end and said point of string attachment;

a connecting member connecting the limb sections to each other and mounted to the pair of limb sections limiting relative movement between the pair of limb sections; and comprising a hole through at least one of said pair of limb sections for receiving said connecting member, and at least one fastener retaining said connecting member to said at least one of said limb sections.

22. A limb for an archery bow, comprising:

a body with one end attached to a handle portion of an archery bow and a free end having a point of string attachment generally adjacent to the free end and having a split section defining a pair of limb sections at least substantially separate from one another between said one end and said point of string attachment;

a connecting member connecting the limb sections to each other and mounted to the pair of limb sections limiting relative movement between the pair of limb sections; and wherein at least one of said limb sections has a blind hole for receiving an end of said connecting member retaining said connecting member relative to said at least one of said limb sections.

23. A limb for an archery bow, comprising:

a body with one end attached to a handle portion of an archery bow and a free end having a point of string attachment generally adjacent to the free end and having a split section defining a pair of limb sections at least substantially separate from one another between said one end and said point of string attachment;

a connecting member connecting the limb sections to each other and mounted to the pair of limb sections limiting relative movement between the pair of limb sections; and a coating on at least a portion of said connecting member acting as a dampener between said connecting member and a limb section.

24. A limb for an archery bow, comprising:

a body with one end attached to a handle portion of an archery bow and a free end having a point of string attachment generally adjacent to the free end and having a split section defining a pair of limb sections at least substantially separate from one another between said one end and said point of string attachment;

a connecting member connecting the limb sections to each other and mounted to the pair of limb sections limiting relative movement between the pair of limb sections; and a dampener disposed on said connecting member, said dampener being compressed between said pair of limb sections.

* * * * *

UNITED STATES PATENT AND TRADEMARK OFFICE

CERTIFICATE OF CORRECTION

PATENT NO. : 6,684,870 B1
DATED : February 3, 2004
INVENTOR(S) : Spencer D. Land It is certified that error appears in the above-identified patent and that said Letters Patent is hereby corrected as shown below:

Column 5,
Line 61, after "claim" insert -- 1 --.

Column 6,
Line 2, after "sides" insert -- of --.

Signed and Sealed this

Fifteenth Day of June, 2004

JON W. DUDAS
*Acting Director of the United States Patent and Trademark Office*